US006502354B2

(12) United States Patent
McClure et al.

(10) Patent No.: US 6,502,354 B2
(45) Date of Patent: Jan. 7, 2003

(54) CRYPT BURIAL APPARATUS

(75) Inventors: Ralph E. McClure, Sacramento, CA (US); Eugene Jenkins, Sacramento, CA (US)

(73) Assignee: Paul Mains (third), Lodi, CA (US)

( * ) Notice: Subject to any disclaimer, the term of this patent is extended or adjusted under 35 U.S.C. 154(b) by 0 days.

(21) Appl. No.: 09/760,255

(22) Filed: Jan. 12, 2001

(65) Prior Publication Data

US 2002/0007603 A1 Jan. 24, 2002

Related U.S. Application Data

(63) Continuation-in-part of application No. 09/093,987, filed on Jun. 8, 1998, now abandoned.

(51) Int. Cl.[7] ..... E04H 13/00; A61G 17/00

(52) U.S. Cl. ..... 52/133; 52/128; 52/157; 27/1

(58) Field of Search ..... 52/128, 133, 157, 52/169.6, 169.1, 143, DIG. 11, 136; 27/1, 27, 28, 35; 220/671

(56) References Cited

U.S. PATENT DOCUMENTS

| | | | | |
|---|---|---|---|---|
| 1,460,223 | A | * | 6/1923 | Bird |
| 3,335,531 | A | * | 8/1967 | Grimelli |
| 3,744,192 | A | * | 7/1973 | Burnett |
| 3,769,764 | A | * | 11/1973 | Young |
| 3,806,265 | A | * | 4/1974 | Hattan ..... 403/320 |
| 3,943,670 | A | * | 3/1976 | Miller |
| 4,294,053 | A | * | 10/1981 | Lopes |
| 5,522,184 | A | * | 6/1996 | Oviedo-Reyes |
| 6,247,276 | B1 | * | 6/2001 | Masters |

* cited by examiner

*Primary Examiner*—Carl D. Friedman
*Assistant Examiner*—Kevin McDermott
(74) *Attorney, Agent, or Firm*—Mark C. Jacobs

(57) ABSTRACT

A burial apparatus for underground crypts, preferably those that include space for two stacked caskets, which apparatus includes a ground auger, a turnbuckle connected thereto and a flanged inverted L-shaped member connected to the turnbuckle and engaged with the crypt to retain the crypt within the ground. The apparatus works particularly well with an empty crypt and with a dual crypt when opened to receive a second casket.

5 Claims, 6 Drawing Sheets

CRYPT BURIAL APPARATUS

RELATION TO OTHER APPLICATIONS

This application is a continuation in part of our co-pending application U.S. Ser. No. 09/093,987 filed Jun. 8, 1998 now abandoned.

FIELD OF THE INVENTION

The invention pertains to new double depth crypt burial apparatus which employs a crypt retention means; namely a ground auger.

BACKGROUND OF THE INVENTION

The present invention relates to an underground crypt having two horizontally spaced crypt compartments for two vertically stacked caskets in one double depth crypt vault with a center dividing shelf to separate the two vertically stacked caskets and sealed with a vault lid.

At the present time, it is becoming more feasible to cemeteries to use double depth lawn crypts so that two caskets in a single grave is possible. This provides greater utilization of land. It is desirable to have one single crypt vault unit that can carry two stacked caskets that can be placed even next to a single burial if so desired.

The center dividing shelf employed serves to insure that a second burial in the same grave opening will not disturb the casket of the first burial.

The problem arises sometimes that due to excess water or improper burial procedures, that a crypt may tend to rise upwardly and displace soil. Therefore, applicants have devised a new burial APPARATUS which utilizes at least one ground auger in combination with a turnbuckle to retain the crypt at its desired depth. Often when the second burial is about to transpire and the weight of the earth on the crypt is removed, the large crypt may tend to rise. Such could prove not only to be embarrassing, but could create an air pocket beneath the crypt, which could render the completion of the reburial somewhat difficult. Also, should it be desired to bury the crypt empty in anticipation of later occupancy, the ground augers retain the crypt below ground. Thus the need is seen for the burial apparatus of this invention which comprises a double depth crypt with at least one turnbuckle ground auger attached thereto.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the detailed description, taken in conjunction with the accompanying drawings.

BRIEF DESCRIPTION OF THE FIGURES

FIG. 25 is a perspective view of a clamping means for the retention of the flexible flange of the burial apparatus of, this invention:

SUMMARY OF THE INVENTION

The present invention relates to which vault is used in conjunction with at least one turnbuckle based ground auger to form a safe and secure burial system. The present invention provides a means to be engaged to a slotted handle, which is defined herein as an extended support unit of a burial crypt, to hold the crypt vault in place when in the grave site. The means constitutes at least one and preferably two ground augers, each having one end of a turnbuckle connected thereto, the turnbuckle being connected at its other to a flanged inverted L-shaped member which engages the slotted handle of a crypt.

DESCRIPTION OF THE PREFERRED EMBODIMENT

Figure 1:
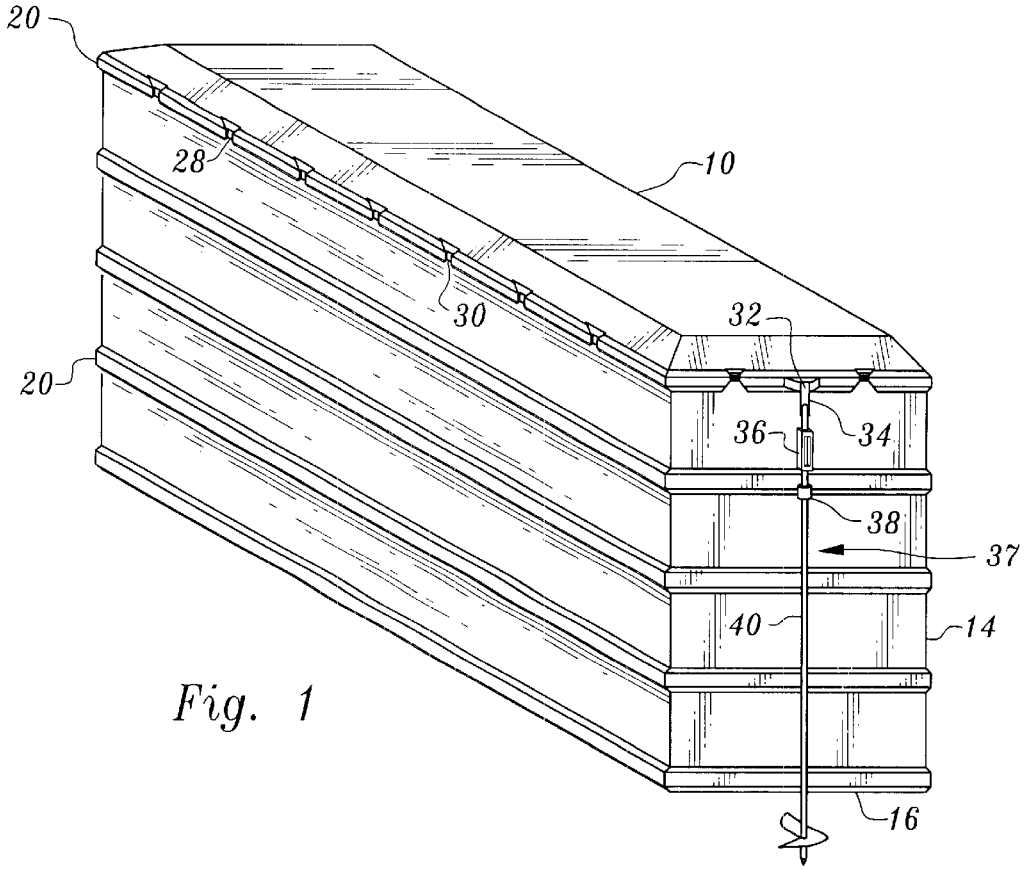
FIG. 1 is a perspective view of the double depth crypt vault of this invention.

FIG. 1 depicts the present invention of a single unit double depth crypt vault 16 with support stiffeners ribs 20 and crypt vault lid 10 with security clips 30 securing the vault lid to the vault walls. As shown there is a ground auger 37 that is to be drilled into the lower portion of the ground below the vault to hold the vault in place. This is to assure that if the vault is preset in the ground with no caskets, the ground auger 37 will hold the double depth crypt vault in place.

Figure 2:
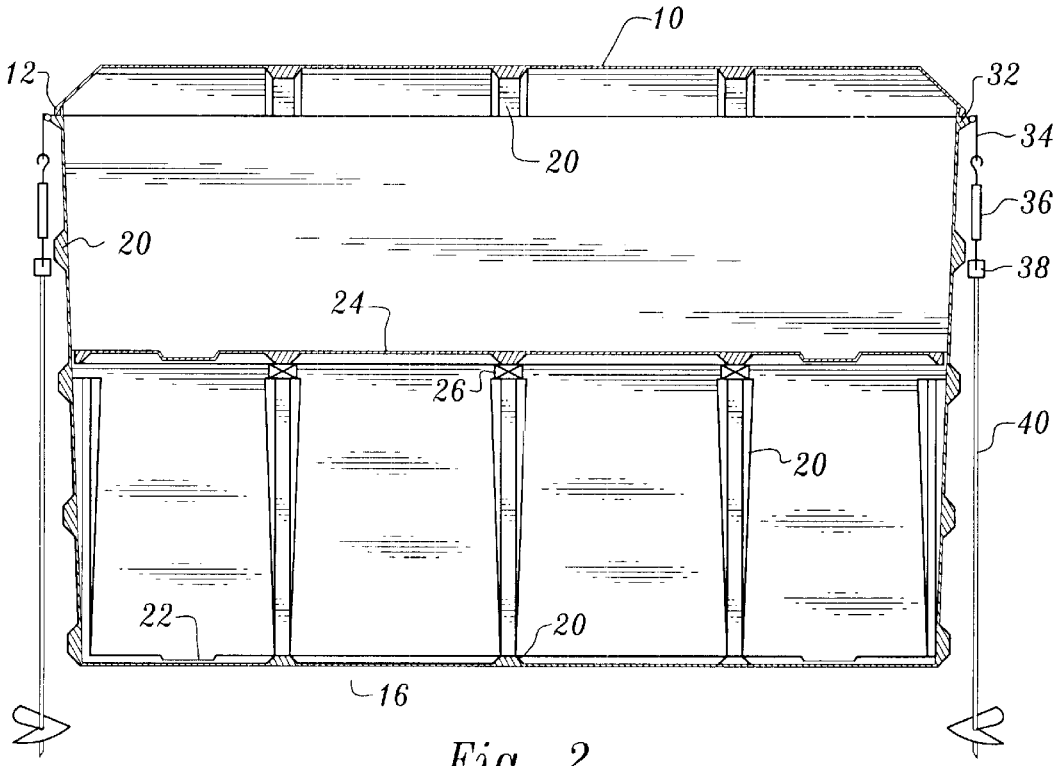
FIG. 2 is a sectional view thereof with a vault lid attached.

FIG. 2 shows the vault lid 10 and side view of double depth crypt vault with support stiffener ribs 20 along with indentation for lower straps 22 in the bottom of the vault 16 and in the center dividing shelf 24. Temporary support bars 26 hold up dividing shelf 24 and allow wall support against the ground pressure of dirt. Rubber seal 12 for vault lid 10, extended support unit 32 that holds the top of the ground auger 37 unit in place. Tie down bracket 34 connects to the top of turn buckle 36. The bottom of turn buckle 36 connects to auger plate 38 that is connected to ground auger shaft 40.

Figure 3:
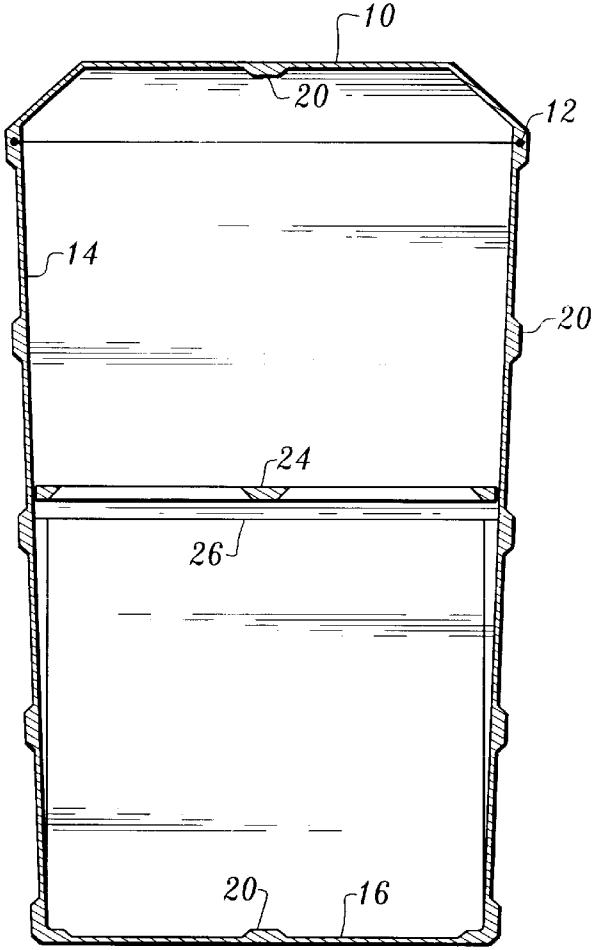
FIG. 3 is a front to back sectional view of the combined vault and lid.

FIG. 3 is the end view of the present invention with support stiffener ribs 20 in the vault lid 10 and support stiffener ribs 20 in the vault walls 14 and vault bottom floor 16 also showing the center dividing shelf 24 resting on temporary support 26. There is a round rubber gasket seal 12 that surrounds the entire vault lid and mates with the top vault walls.

Figure 4:
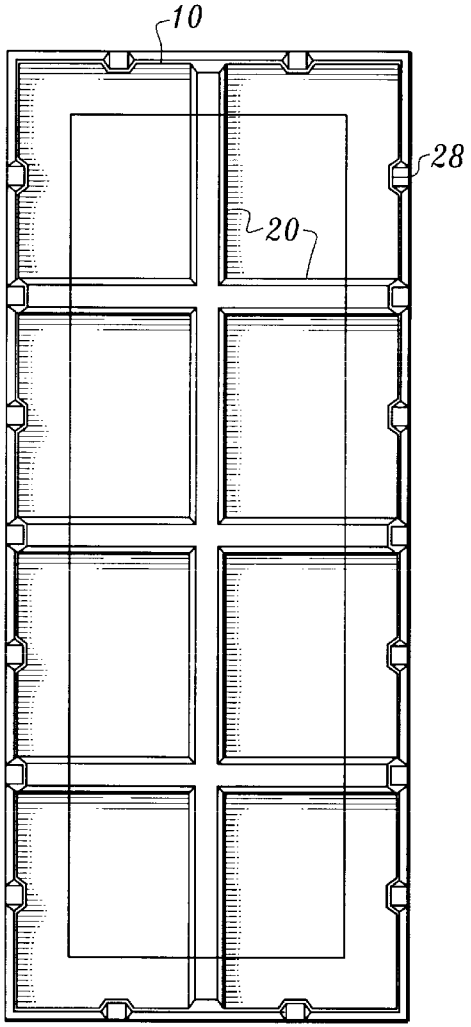
FIG. 4 is a top view of the vault lid.

FIG. 4 is a top view of the vault 10 and the support stiffener ribs 20 along with the areas 28 for secure clips 30 to be attached. These secure clips 30 retain the lid to the vault walls. See also FIG. 8.

Figure 5:
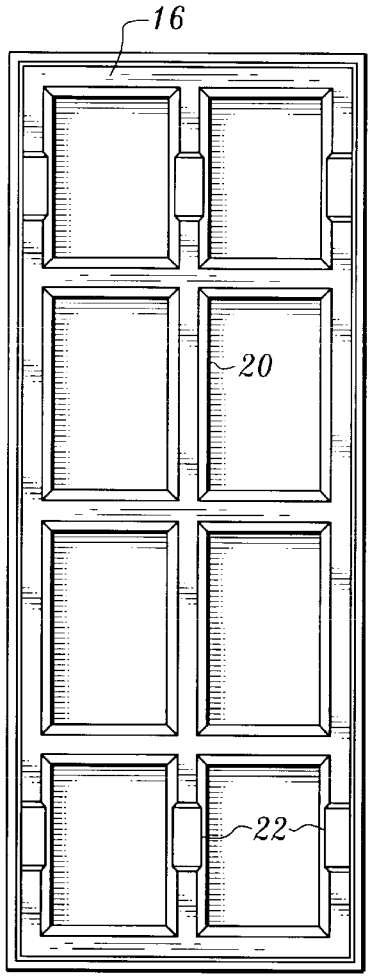
FIG. 5 is a top view of the vault floor.

FIG. 5 is also a top view of the vault floor 16. The support ribs 20 are seen as are the indentation 22 in the floor structure used to facilitate removal of the lowering straps when a casket is laid to rest in the crypt.

Figure 6:
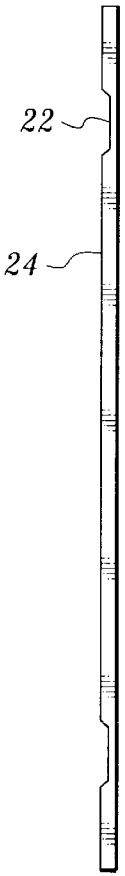
FIG. 6 is an elevational view of a divider shelf as used herein.

FIG. 6 is a vertical view of the center dividing shelf 24 and the indentations 22 for the lowering straps, not seen.

Figure 7:
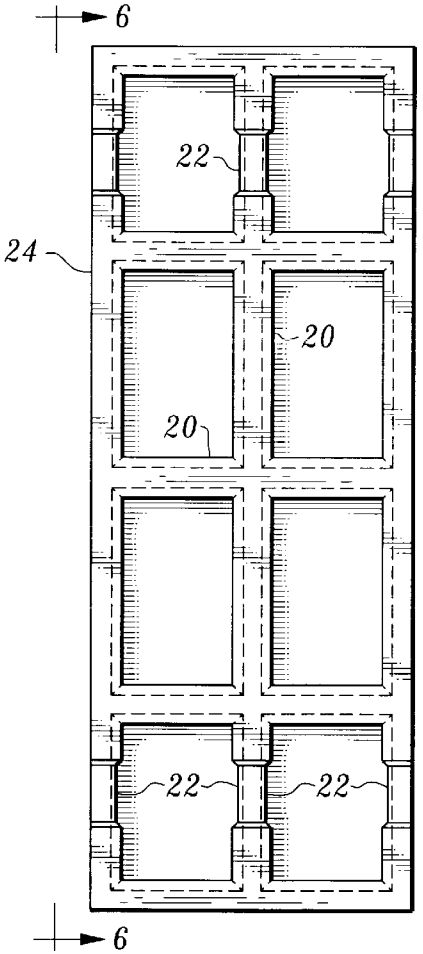
FIG. 7 is a top plan view of the divider shelf.

FIG. 7 is a top view of the vault center dividing shelf 24 which also shows the support stiffener ribs 20 and indentations 22 therein for lowering straps, again not seen.

Figure 8:
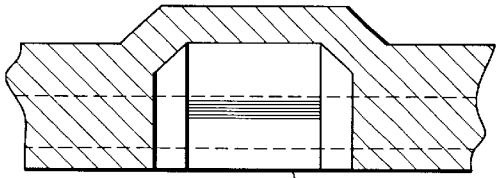
FIG. 8 is a top view of a portion of the inventive apparatus.

FIG. 8 showing a top view of the center dividing shelf 24 resting on the temporary support bar 26.

Figure 9:
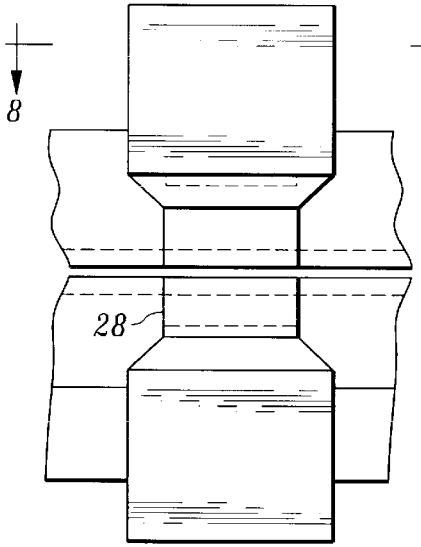
FIG. 9 is a side view of the lid portion of the invention.

FIG. 9 depicts a top view showing the area 28 that will hold the security clips 30 to be used to retain the lid in place.

Figure 11:
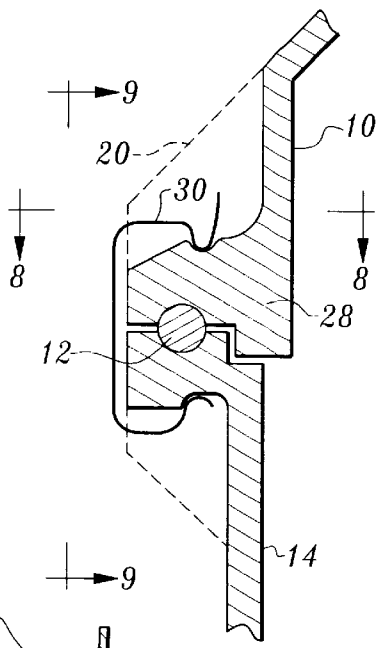
FIG. 11 is a diagrammatic view of the engagement of two portions of the invention.
Figure 10:
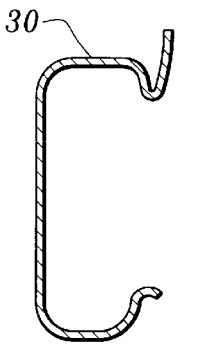
FIG. 10 is an elevational view of a security clip employed herein.

FIG. 10 shows a side view of a portion of the vault lid, mated to the vault wall at the security clip area 28 prior t5o the installation of the clip 30 shown in FIG. 11. See also FIG. 12.

FIG. 11 is an end view of a security clip 30 that holds the vault walls at location 28.

Figure 12:
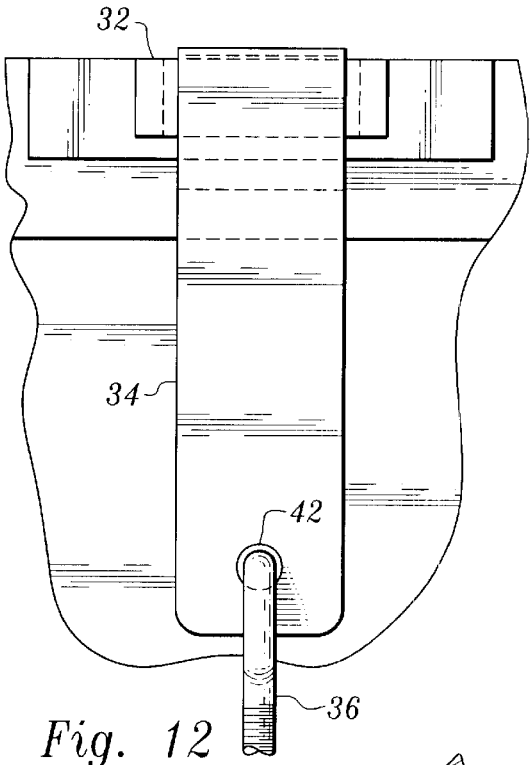
FIG. 12 is a side elevational view of an element of this invention.

FIG. 12 is a sectional view of the vault lid 10 resting on the vault wall 14 and showing the security clip area 28. A rubber seal 12 is disposed between the lid and the vault body to seal out moisture and help retain the vault lid 10 to the vault wall 14. The balance of the retention is provided by a security clip 30 that can be springingly located in place. These are easily removed when the second burial takes place and returned to position.

FIG. 12 is a side elevational view of the vault showing the tie down bracket 34, which is noted to be formed in the configuration of a flexible flanged inverted L-shaped member, which is locked in place in the extended support unit 32 located at the top of the vault wall. The aperture 42 at the lower end of said tie down bracket receives one hook 36H of the turnbuckle See FIGS. 13 and 14.

Figure 15:
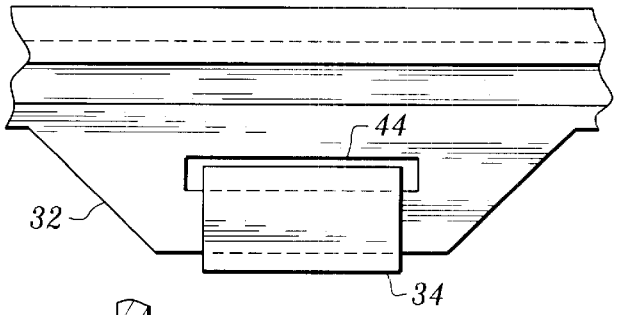
FIG. 15 is a top view of an element of a portion of the invention.
Figure 21:
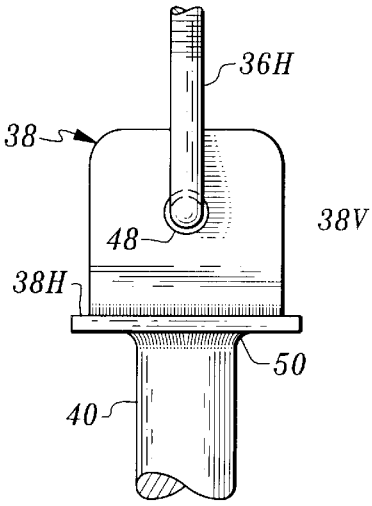
FIGS. 21 and 22 show a side view of the lower end of a turn buckle attached to the auger mount plate's vertical section.
Figure 22:
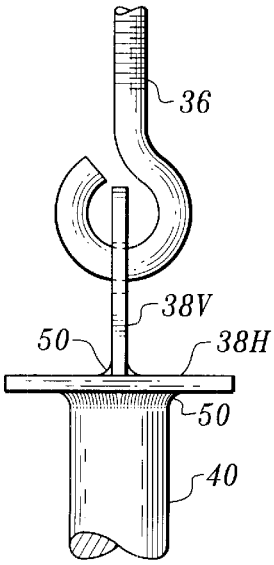

Auger plate 38 is an inverted T-shaped member, which may have optionally chamfered edges for safety reasons, and is shown as such in the FIG. 21. This plate has a central throughbore 48 for receiving the second or lower of the two turnbuckle hooks 36H. Bore 48 is notevisible in FIG. 15. Auger plate 38 is welded to the upper end of the shaft 40 of ground auger 37. A reference is made to FIG. 22. As in a conventional ground auger, this auger includes at least one flute 41 to be rotated into the ground as the anchoring means.

Figure 13:
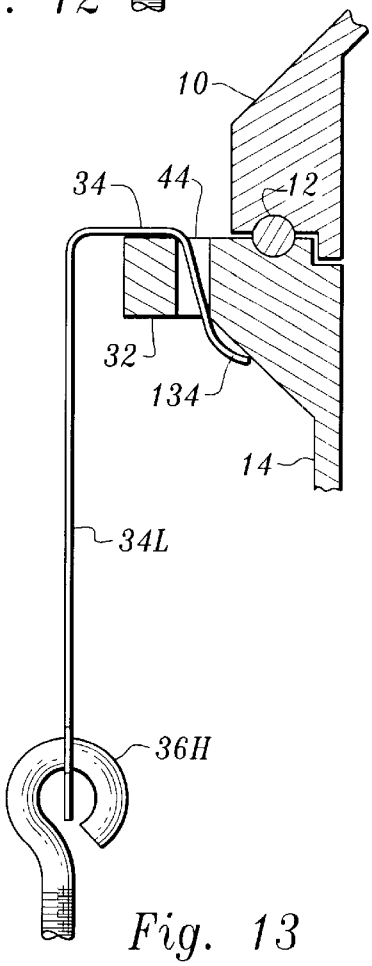
FIG. 13 is an end view of the element shown in FIG. 12.

FIG. 13 is an end view of the tie down bracket 34 that is placed on the end of the vault wall 14 that connects to the turn buckle 36. This arcuate flanged inverted L-shaped bracket 34, has its flanged area 134 disposed through opening 44 of the extended support unit 32. The vault lid is seen resting on the vault wall 14 with the rubber seal 12 in position to seal the vault lid 10 to the vault wall 14 as discussed previously.

Figure 14:
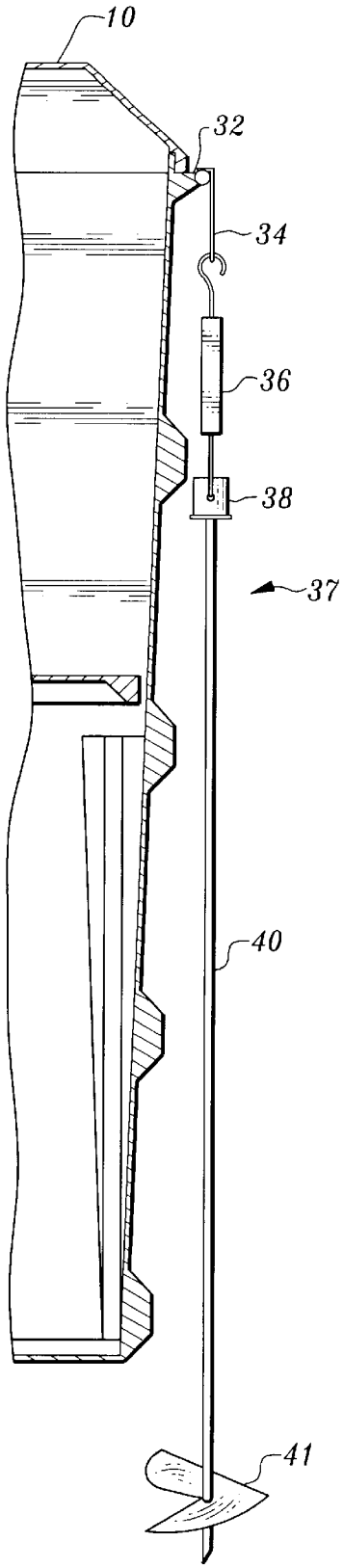
FIG. 14 is a closeup view similar to FIG. 2 showing the various components of the burial system of this invention.

FIG. 14. is a closeup view similar to FIG. 2 showing the various components of the burial system of this invention. Thus as is seen by reference to FIG. 13, the extended section 32, ie. a handle has a slot 44 extending vertically therethrough. The flanged inverted L-shaped member, 34, has a flexible flange section 134 integrally attached at the distal end of the short arm (the horizontal arm) of the inverted L-shaped member. Flange section 134 is placed in the slot 44 from the top of the slot downwardly to engage the slot, leaving the long arm 34L of FIG. 13 to depend downwardly.

Figure 16:
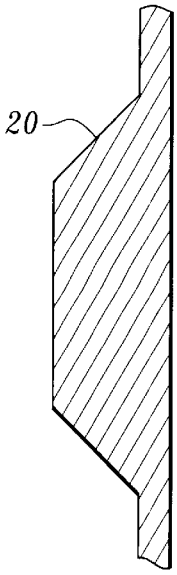
FIG. 16 is an end view of a stiffener rib as employed herein.

FIG. 16 is a top view of the rectangular opening 44 which is formed as a notched area in extended support unit 32 for the down bracket 34 that is at each end of the vault.

Figure 17:
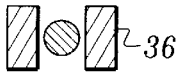
FIG. 17 is a top plan view of a common turnbuckle.

FIG. 17 is an end view of the support stiffener rib 20 that is part of the vault walls and floor and vault lid and designed for added strength shown in FIGS. 1, 2, 3, 4, 5, 7 12, 17 and 24.

FIG. 17 is atop view of the turn buckle 36. The turn buckle is designed to be connected to the auger that is on each end of the vault for the purpose of securing the vault in the ground after it is placed in the grave opening as previously discussed in detail with respect to FIG. 14. See FIGS. 1 and 2.

Figure 18:
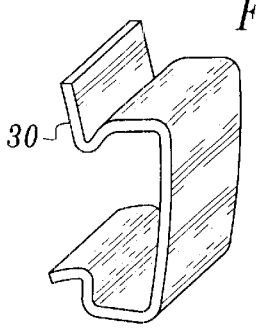
FIG. 18 is a perspective view of a security clip employed herein.
Figure 19:
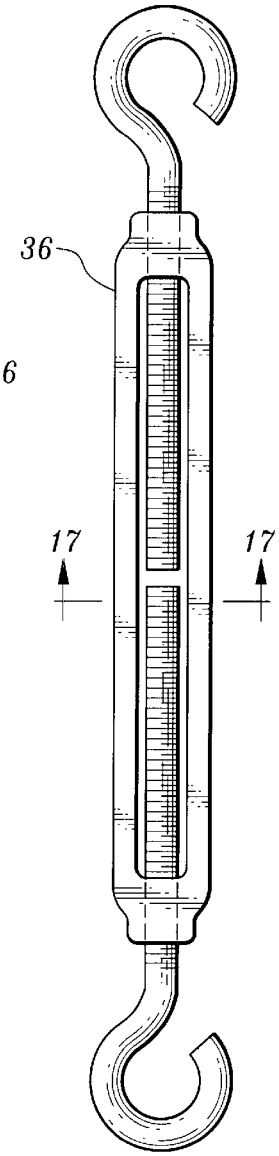
FIG. 19 is an elevation view of a common turnbuckle.

FIG. 18 is a perspective view of the security clip 30 that locks the vault lid to the vault walls as shown in FIG. 11. This preferably spring steel clip can be readily removed when needed for the second burial.

Figure 20:
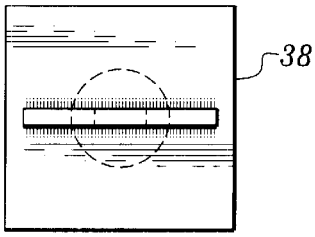
FIG. 20 is a top view of another element employed herein.
Figure 23:
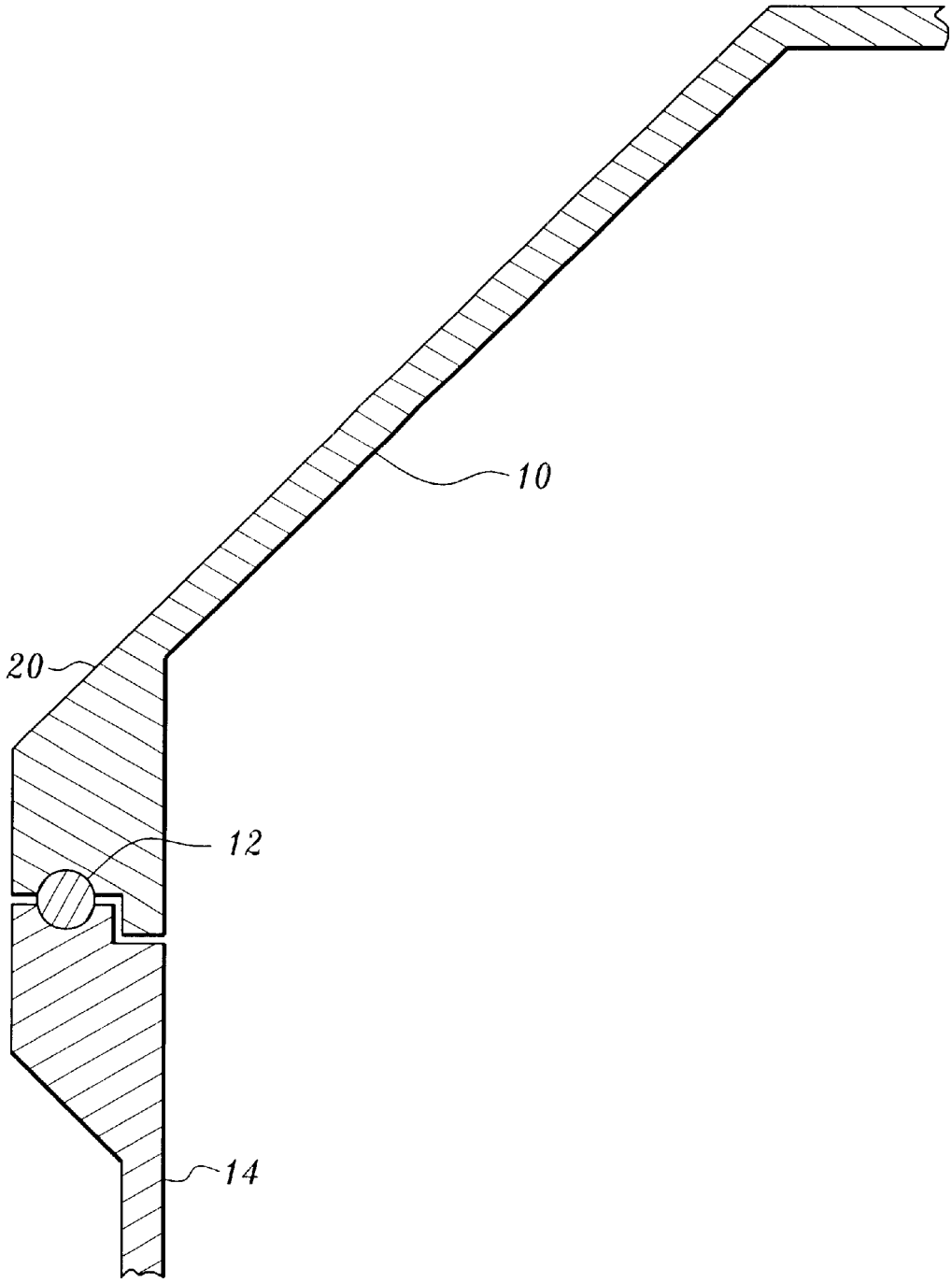
FIG. 23 is a diagrammatic view depicting the engagement of the vault lid and vault.

FIG. 20 depicts an elevational view of a conventional turn buckle 36 that is used to secure the tie down bracket 34 and the auger shaft 40 together as shown elsewhere in these drawings and forma a part of the burial system of this invention.

FIG. 21 shows a top view of the auger plate 38 that is attached to the bottom of the turn buckle 36.

FIG. 21 shows a side view of the lower end of the turnbuckle 36 attached to the auger amount plate 38's vertical section 38V via throughbore 48 in said vertical section. The horizontal section 38 H is attached to the vertical section 38V by fillet welds 50, and the horizontal section 38H is in turn welded to the auger shaft 40S. This view is rotated 90 degrees in FIG. 22.

The burial system of this invention which comprises the ground auger connected to the turnbuckle and the turnbuckle in turn connected to the flanged inverted L-shaped member, also referred to as the tie down bracket, works in conjunction with the notched out opening, in the extended support unit of the dual casket crypt disclosed herein.

It is to be seen that the crypt disclosed herein and claimed in our parent application need not be employed. Any crypt that has a means for retaining the flanged inverted L-shaped member may be retained in place by the burial apparatus of this invention. Thus a handle disposed on the crypt which has as a part thereof, a clamping means to hold the flexible flange could also be retained by the safe burial apparatus of this invention. The turnbuckle is used in its conventional operating mode to create a downward force such that the crypt is retained from rising by the flutes of the auger, buried into the ground below the grave site.

Since certain changes may be made in the above described apparatus without departing from the scope of the invention herein involved, it is intended that matter contained in the above description and shown in the accompanying drawings shall be interpreted as illustrative and not in a limiting sense.

We claim:

1. In combination, a burial crypt having at least one handle thereon, said handle having a flange retaining means, and an apparatus for ensuring retention of the crypt in the ground, which apparatus comprises:

a. a flexible flanged inverted L-shaped member having a downwardly depending arm to which is connected at the lower end of said arm, b. a turnbuckle, and which turnbuckle is also connected to, c. a ground auger having an auger plate at one end and at least one flute at the other end, the auger plate being the part of the ground auger connected to the turnbuckle.

2. The combination of claim 1 wherein the retaining means on the handle of the crypt is a slot into which the flexible flange is inserted.

3. The combination of claim 1 wherein the retaining means on the handle of the crypt is a clamp into which the flexible flange is inserted.

4. The combination of claim 1, wherein the auger has only one flute.

5. The combination of claim 1, wherein the turnbuckle includes a pair of oppositely disposed hooks, one of which is disposed through the auger plate, and the other of which is disposed through the inverted L-shaped member.

* * * * *